US008852500B2

(12) United States Patent
Koizumi et al.

(10) Patent No.: US 8,852,500 B2
(45) Date of Patent: Oct. 7, 2014

(54) NI-BASE SUPERALLOY, METHOD FOR PRODUCING THE SAME, AND TURBINE BLADE OR TURBINE VANE COMPONENTS

(75) Inventors: Yutaka Koizumi, Tsukuba (JP); Hiroshi Harada, Tsukuba (JP); Tadaharu Yokokawa, Tsukuba (JP); Toshiharu Kobayashi, Tsukuba (JP)

(73) Assignee: National Institute for Materials Science, Ibaraki (JP)

( * ) Notice: Subject to any disclaimer, the term of this patent is extended or adjusted under 35 U.S.C. 154(b) by 1291 days.

(21) Appl. No.: 12/225,254

(22) PCT Filed: Mar. 16, 2007

(86) PCT No.: PCT/JP2007/055450

§ 371 (c)(1),
(2), (4) Date: Feb. 17, 2010

(87) PCT Pub. No.: WO2007/119404

PCT Pub. Date: Oct. 25, 2007

(65) Prior Publication Data

US 2010/0226779 A1 Sep. 9, 2010

(30) Foreign Application Priority Data

Mar. 20, 2006 (JP) ..... 2006-077256

(51) Int. Cl.

| | |
|---|---|
| ***C22C 19/05*** | (2006.01) |
| ***F01D 5/14*** | (2006.01) |
| ***C22F 1/10*** | (2006.01) |

(52) U.S. Cl.

USPC ..... 420/444; 416/223 R; 420/448; 148/555

(58) Field of Classification Search

CPC ..... C22C 19/057
USPC ..... 420/444, 448; 416/223 R; 148/555
See application file for complete search history.

(56) References Cited

U.S. PATENT DOCUMENTS

| | | | | |
|---|---|---|---|---|
| 4,643,782 | A | 2/1987 | Harris et al. | |
| 4,719,080 | A * | 1/1988 | Duhl et al. | 420/443 |
| 4,726,101 | A * | 2/1988 | Draghi et al. | 29/889.1 |
| 5,399,313 | A | 3/1995 | Ross et al. | |
| 6,673,308 | B2 * | 1/2004 | Hino et al. | 420/448 |
| 7,473,326 | B2 * | 1/2009 | Kobayashi et al. | 148/404 |
| 2005/0092398 | A1 * | 5/2005 | Kobayashi et al. | 148/404 |
| 2005/0260346 | A1 * | 11/2005 | Heng et al. | 427/248.1 |

FOREIGN PATENT DOCUMENTS

| | | | | |
|---|---|---|---|---|
| JP | 53-146223 | | 12/1978 | |
| JP | 59-19032 | | 1/1984 | |
| JP | 5-59474 | | 3/1993 | |
| JP | 7-138683 | | 5/1995 | |
| JP | 2005-097649 | | 4/2005 | |
| WO | 03/080882 | | 10/2003 | |
| WO | WO 2007/087423 | * | 8/2007 | B05D 1/36 |

* cited by examiner

*Primary Examiner* — Jessee Roe

(74) *Attorney, Agent, or Firm* — Wenderoth, Lind & Ponack, L.L.P.

(57) ABSTRACT

A Ni-base superalloy having a chemical composition comprising Cr: 3.0-5.0 wt %, Co: 5.0-10.0 wt %, Mo: 0.5-3.0 wt %, W: 8.0-10.0 wt %, Ta: 5.0-8.0 wt %, Nb: 3.0 wt % or less, Al: 4.5-6.0 wt %, Ti: 0.1-2.0 wt %, Re: more than 3.0-4.0 wt %, Ru: 0.2-4.0 wt %, Hf: 0.01-0.2 wt %, and the balance being Ni and unavoidable impurities, a method for producing the same, and turbine blade or turbine vane components are disclosed. The Ni-base superalloy has high creep strength and textural stability under high temperature environment, and is excellent in applicability to turbine blade or turbine vane components of large-sized gas turbines.

4 Claims, 1 Drawing Sheet

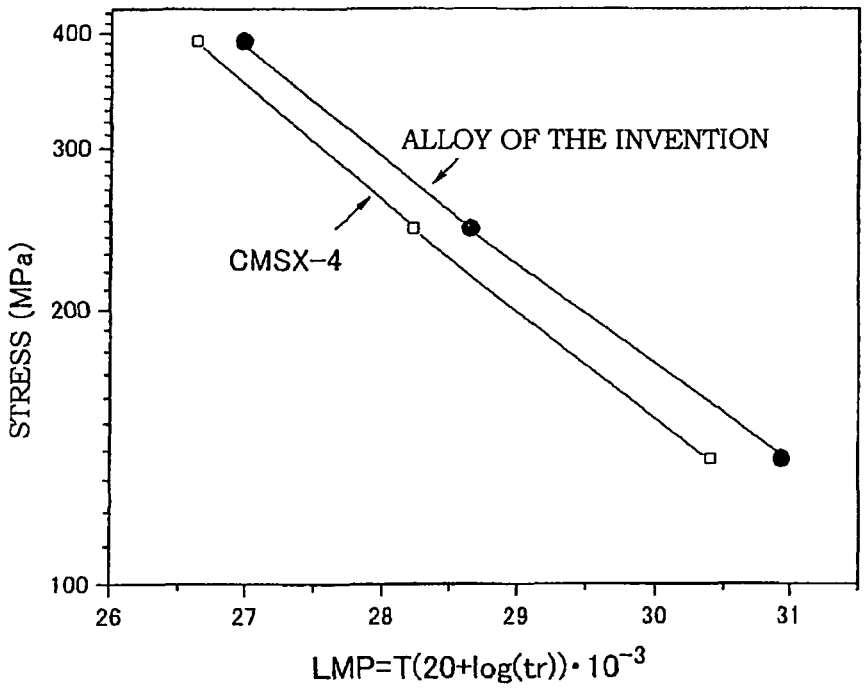
400
300
200
100
STRESS (MPa)
ALLOY OF THE INVENTION
CMSX-4
26
27
28
29
30
31
LMP=T(20+log(tr))·10^-3

NI-BASE SUPERALLOY, METHOD FOR PRODUCING THE SAME, AND TURBINE BLADE OR TURBINE VANE COMPONENTS

TECHNICAL FIELD

The present invention relates to a Ni-base superalloy, a method for producing the same, and turbine blade or turbine vane components. More particularly, the present invention relates to a novel Ni-base superalloy having excellent textural stability and creep property at high temperature and suitable as a member used at high temperature under high stress, such as turbine blades, turbine vanes or the like of jet engines, gas turbines or the like, a method for producing the same, and turbine blade or turbine vane components.

BACKGROUND ART

Due to rise in combustion temperature posed by high efficiency of a gas turbine, a material of rotor blades and stator blades of turbines has varied from the conventionally cast alloy to a directionally solidified alloy in which crystal grain boundary in a stress axis direction was eliminated to improve creep strength at high temperature, and further to a single crystal alloy in which the crystal grain boundary itself was eliminated. Furthermore, the single crystal alloy seeks further improvement of creep strength, and development of from the first generation single crystal alloy to the second generation and third generation single crystal alloys has proceeded. The first generation single crystal alloy is an alloy to which rhenium (Re) is not added, and examples thereof include CMSX-2 (Patent Document 1), Rene' N4 (Patent Document 2) and PWA-1480 (patent Document 3).

The second generation single crystal alloy is an alloy in which creep resistant temperature was improved about 30° C. than the first generation single crystal alloy by adding about 3% of rhenium, and examples thereof include CMSX-4 (Patent Document 4), PWA-1484 (Patent Document 5) and Rene' N5 (Patent Document 6).

The third generation single crystal alloy is an alloy in which creep resistant temperature was tried to improve by adding 5-6% of rhenium, and example thereof is CMSX-10 (Patent Document 7). The above single crystal superalloy has remarkably developed as a blade material of jet engines for mainly aircrafts. Due to demand of high temperature for the purpose of improving combustion efficiency, technical transfer is attempted to industrial large-sized gas turbines.

Patent Document 1: JP-A-59-19032
Patent Document 2: U.S. Pat. No. 5,399,313
Patent Document 3: JP-A-53-146223
Patent Document 4: U.S. Pat. No. 4,643,782
Patent Document 5: U.S. Pat. No. 4,719,080
Patent Document 6: JP-A-5-59474
Patent Document 7: JP-A-7-138683

DISCLOSURE OF THE INVENTION

Problems that the Invention is to Solve

A blade material of jet engines, gas turbines or the like is required that TCP (Topologically Close-Packed phase) phase is not formed when used at high temperature, that is, textural stability is good.

In the third generation single crystal alloy, improvement in strength could be attempted to the second generation single crystal by adding 5-6% of rhenium. On the negative side, TCP phase becoming a starting point of creep and low cycle subversion by long-term use is liable to be formed. From this point, it is difficult to apply the third generation single crystal superalloy to a large-sized gas turbine, and the desire of realizing a material having higher creep strength due to rise of combustion temperature is not answered.

Accordingly, the invention has been made to solve the above problems, and has an object to provide a Ni-base superalloy having improved creep strength and textural stability under high temperature environment, a method for producing the same, and high temperature components for gas turbines prepared from the Ni-base superalloy, that is, turbine blade or turbine vane components.

Means for Solving the Problems

The present invention is to solve the above problems and has the following aspects.

A first aspect has a chemical composition comprising Cr: 3.0-5.0 wt %, Co: 5.0-10.0 wt %, Mo: 0.5-3.0 wt %, W: 8.0-10.0 wt %, Ta: 5.0-8.0 wt %, Nb: 3.0 wt % or less, Al: 4.5-6.0 wt %, Ti: 0.1-2.0 wt %, Re: more than 3.0-4.0 wt %, Ru: 0.2-4.0 wt %, Hf: 0.01-0.2 wt %, and the balance being Ni and unavoidable impurities.

A second aspect has Cr: 4.0-5.0 wt %, Co: 7.0-8.0 wt %, Mo: 1.2-2.2 wt %, W: 8.0-8.8 wt %, Ta: 5.7-6.7 wt %, Al: 4.8-5.6 wt %, Ti: 0.2-0.8 wt %, Re: 3.2-3.8 wt %, and Ru: 1.5-2.5 wt %, in the first aspect.

A third aspect contains the elements of C: 0.05 wt % or less, Zr: 0.1 wt % or less, V: 0.5 wt % or less, B: 0.02 wt % or less, Si: 0.1 wt % or less, Y: 0.2 wt % or less, La: 0.2 wt % or less, and Ce: 0.2 wt % or less alone or in combination, in addition to the first or second aspect.

A fourth aspect is that the Ni-base superalloy having any one of the first to third aspects is cast by a conventional casting method, a directional solidification method or a single crystal solidification method.

A fifth aspect is that in the fourth aspect, after casting, a pre-heat treatment at 1,260 to 1,300° C. for 20 minutes to 2 hours is applied, and a solution treatment at 1,300 to 1,350° C. for 3 to 10 hours, a primary aging treatment at 1,050 to 1,150° C. for 2 to 8 hours, and a secondary aging treatment at 800 to 900° C. for 10 to 24 hours are then applied.

A sixth aspect is that turbine blade or turbine vane components comprise the Ni-base superalloy having any one of the first to third aspects as at least a part of its constitution.

Effects of the Invention

According to the present invention, a Ni-base superalloy having high creep strength and textural stability under high temperature environment, which is excellent in applicability to turbine blade or turbine vane components or the like of large-sized gas turbines is realized, and large-sized gas turbine components prepared from such a Ni-base superalloy are provided.

BRIEF DESCRIPTION OF DRAWINGS

FIG. 1 is a view comparing creep strength between the Ni-base superalloys of the present invention prepared in the Examples and the conventional alloy CMSX-4 in Larson-Miller diagram.

BEST MODE FOR CARRYING OUT THE INVENTION

In the Ni-base superalloy of the first invention, Co is substituted with Ni in a gamma phase to solid solution strengthen a matrix, thereby increasing high temperature strength. The content of Co is 5.0 to 10.0 wt %. Where the content is less than 5.0 wt %, high creep strength cannot be expected. Where the content of Co exceeds 10 wt %, a gamma prime amount is reduced, and high creep strength cannot be expected.

Cr is necessary as an element effective to improve high temperature corrosion resistance. The content of Cr is required to be 3.0 to 5.0 wt %. The reason that the content of Cr is defined 3.0 wt % or more in the invention is that where the content is less than 3.0 wt %, the desired high temperature corrosion resistance cannot be ensured. Where the content of Cr exceeds 5.0 wt %, precipitation of a gamma prime phase is suppressed, and additionally, a harmful phase such as σ phase or μ phase is formed, thereby decreasing high temperature strength.

Mo is necessary as an element effective to move lattice constant misfit into a negative side, form a dense dislocation network at the interface between a gamma phase and a gamma prime phase and improve high temperature creep strength. The content Mo is required to be 0.5 to 3.0 wt %.

W has the effect to improve creep strength over from high temperature to low temperature, and is therefore required to add to the Ni-base superalloy of the invention in an amount of 8.0 to 10.0 wt %. On the other hand, where the content exceeds 10.0 wt %, formation of a harmful phase is assisted. Therefore, the upper limit of the content is 10.0 wt %.

Al is required to be 4.5 wt % or more in order to form a gamma prime phase which is indispensable to improve high temperature strength. However, where the content exceeds 6.0 wt %, a coarse crystal called a eutectic gamma prime is formed, and creep strength is decreased. For this reason, the content is 4.5 to 6.0 wt %.

Ta is an element effective to strengthen a gamma prime phase, thereby improving creep strength. Therefore, the content is required to be 5.0 to 8.0 wt %. Where the content exceeds 8.0 wt %, formation of a harmful phase is assisted. Therefore, the upper limit is 8.0 wt %.

Nb is an element effective to strengthen a gamma prime phase, thereby improving creep strength. In the Ni-base superalloy of the invention, solid solution strengthening of a gamma prime phase is mainly performed by Ta, but the same function is obtained even by Nb. As compared with the case of containing Ta alone, where Nb is contained together with Ta, there is the merit that a solid solution amount can be increased. However, where the content exceeds 3.0 wt %, formation of a harmful phase is assisted. Therefore, the content is 3.0 wt % or less.

Ti is an element effective to strengthen a gamma prime phase, thereby improving creep strength. Therefore, the content of Ti is required to be 0.1 to 2.0 wt %. Where the content exceeds 2.0 wt %, formation of a harmful phase is assisted. Therefore, the upper limit is 2.0 wt %.

Re is an element to solid-solution strengthen a gamma phase, thereby improving high temperature corrosion resistance. Where the content is 3.0 wt % or less, creep strength is decreased, and where the content exceeds 4.0 wt %, formation of TCP phase such as Re—Mo, Re—W or Re—Cr—W is accelerated, thereby decreasing creep strength. Therefore, the content is required to be more than 3.0 to 4.0 wt %.

Ru is an element to improve creep strength at low temperature side. The content of Ru is required to be 0.2 to 4.0 wt %. Where the content is less than 0.2 wt %, there is no effect to prevent a harmful phase, and where the content exceeds 4.0 wt %, creep strength is decreased.

Hf has the effect to improve oxidation resistance, and is therefore effective to be added to the Ni-base superalloy of the invention. However, where the content exceeds 0.2 wt %, formation of a harmful phase is assisted. Therefore, the content is required to be 0.01 to 0.2 wt %.

The second invention defines more preferable compositional range of the Ni-base superalloy. Specifically, it defines Cr: 4.0-5.0 wt %, Co: 7.0-8.0 wt %, Mo: 1.2-2.2 wt %, W: 8.0-8.8 wt %, Ta: 5.7-6.7 wt %, Al: 4.8-5.6 wt %, Ti: 0.2-0.8 wt %, Re: 3.2-3.8 wt %, and Ru: 1.5-2.5 wt %.

Furthermore, as in the third invention, it is considered that the Ni-base superalloy of the first or second invention further contains the following elements in specific ranges.

V has the effect to improve creep strength at low temperature side, and is therefore effective to be added to the Ni-base superalloy of the invention. However, where the addition amount exceeds 0.5 wt %, formation of a harmful phase is assisted. Therefore, the addition amount is required to be 0.5 wt % or less.

Zr has the effect to improve crystal grain boundary strength, and is therefore effective to be added to the Ni-base superalloy of the invention. However, where the addition amount exceeds 0.1 wt %, formation of a harmful phase is assisted. Therefore, the addition amount is required to be 0.1 wt % or less.

Si has the effect to improve oxidation resistance, and is therefore effective to be added to the Ni-base superalloy of the invention. However, where the addition amount exceeds 0.1 wt %, formation of a harmful phase is assisted. Therefore, the addition amount is required to be 0.1 wt % or less.

C has the effect to form a carbide at the crystal grain boundary, thereby improving creep strength, and is therefore effective to be added to the Ni-base superalloy of the invention. However, where the addition amount exceeds 0.05 wt %, the amount of a carbide is excessive, and an alloy becomes brittle. Therefore, the addition amount is required to be 0.05 wt % or less.

B has the effect to segregate at the crystal grain boundary, thereby improving strength, and is therefore effective to be added to the Ni-base superalloy of the invention. However, the addition amount exceeding 0.02 wt % results in decrease of melting point. Therefore, the addition amount is required to be 0.02 wt % or less.

Y has the effect to improve oxidation resistance, and is therefore effective to be added to the Ni-base superalloy of the invention. However, the addition amount exceeding 0.2 wt % rather results in decrease of oxidation resistance. Therefore, the addition amount is required to be 0.2 wt % or less.

La has the effect to improve oxidation resistance, and is therefore effective to be added to the Ni-base alloy of the invention. However, the addition amount exceeding 0.2 wt % rather results in decrease of oxidation resistance. Therefore, the addition amount is required to be 0.2 wt % or less.

Ce has the effect to improve oxidation resistance, and is therefore effective to be added to the Ni-base superalloy of the invention. However, the addition amount exceeding 0.2 wt % rather results in decrease of oxidation resistance. Therefore, the addition amount is required to be 0.2 wt % or less.

The Ni-base superalloy of the invention having the chemical composition as above can be produced by casting. In casting, a Ni-base superalloy can be produced as a polycrystalline alloy, a directionally solidified alloy or a single crystal alloy by a conventional casting method, a directional solidification method or a single crystal solidification method. The conventional casting method is basically a method of casting using an ingot prepared in the desired chemical composition. The directional solidification method is a method of casting using an ingot prepared in the desired chemical composition, and is a method that a casting mold is heated to a temperature of about 1,500° C. or higher which is a solidification temperature of a superalloy, after a superalloy is charged in the casting mold, for example, the casting mold is gradually moved away from a heating furnace to give temperature gradient, and many crystals are directionally grown. The single crystal solidification method is substantially the same as the directional solidification method, and is a method that a zigzag or spiral selector part is provided before solidification of the desired product, many crystals directionally solidified are formed into a single crystal in the selector part, thereby producing the desired product.

The Ni-base superalloy of the invention obtains high creep strength by applying heat treatment after casting. The standard heat treatment is as follows. After applying a pre-heat treatment at 1,260 to 1,300° C. for 20 minutes to 2 hours, a solution treatment is conducted at 1,300 to 1,350° C. for 3 to 10 hours. Subsequently, a primary aging treatment for the purpose of precipitation of a gamma prime phase is conducted in a temperature range of 1,050 to 1,150° C. for 2 to 8 hours. The primary aging treatment can combine with a coating treatment for the purpose of heat resistance and oxidation resistance. After air cooling, a secondary aging treatment for the purpose of stabilization of a gamma prime phase is subsequently conducted at 800 to 900° C. for 10 to 24 hours, and air cooling is then conducted. The respective air cooling can be replaced with cooling under an inert gas. The Ni-base superalloy produced by the above production method makes it possible to realize high temperature components such as turbine blade and turbine vane components or the like of gas turbines.

The present invention is described in more detail by reference to the following Example. It is needless to say that the invention is not limited by the following Example.

Example

A single crystal of the Ni-base superalloy (composition of Example: 4.5 wt % Cr, 7.5 wt % Co, 1.7 wt % Mo, 8.3 wt % W, 5.2 wt % Al, 6.2 wt % Ta, 0.5 wt % Ti, 0.1 wt % Hf, 3.5 wt % Re, 2.0 wt % Ru, and the balance being Ni) of the present invention was produced by casting with a single crystal solidification method. A pre-heat treatment at 1,280° C. for 1 hour was applied, and a solution treatment and an aging treatment were then conducted. The solution treatment was conducted by maintaining at 1,300° C. for 1 hour, raising the temperature to 1,320° C., and then maintaining for 5 hours. The aging treatment was a primary aging treatment of maintaining at 1,100° C. for 4 hours and subsequently a secondary aging treatment of maintaining at 870° C. for 20 hours.

Creep strength was measured on the sample having the solution treatment and the aging treatment thus applied thereto. In the creep test, time until creep breakage of the sample under tree conditions of temperature of 900° C. and stress of 392 MPa, temperature of 1,000° C. and stress of 245 MPa, and temperature of 1,100° C. and stress of 137 MPa was considered to be a life. Precipitation of TCP was not observed in a metal texture after breakage.

The Ni-base superalloy was compared with the commercially available Ni-base single crystal alloy CMSX-4.

Creep test result of the sample prepared was shown in FIG. 1 together with the conventional alloy.

FIG. 1 showed by arranging with Larson-Miller plot obtained from the creep test result (for example, see Koichi Maruyama and Eiji Nakajima: Material Science of High Temperature Strength (Uchida Rokakuho Publishing Co., Ltd.), 1997, pages 251-270). As is apparent from FIG. 1, it is seen that the Ni-base superalloy of the invention has high creep strength as compared with the conventional alloy CMSX-4.

INDUSTRIAL APPLICABILITY

A Ni-base superalloy having high creep strength and textural stability under high temperature environment, which is excellent in applicability to turbine blade or turbine vane components or the like of large-sized gas turbines is realized, and large-sized gas turbine components prepared from such a Ni-base superalloy are provided.

The invention claimed is:

1. A Ni-base superalloy having a chemical composition consisting of Cr: 3.0-4.5 wt %, Co: 5.0-10.0 wt %, Mo: 0.5-3.0 wt %, W: 8.3-10.0 wt %, Ta: 5.0-8.0 wt %, Nb: 3.0 wt % or less, Al: 4.5-6.0 wt %, Ti: 0.1-2.0 wt %, Re: 3.2-3.8 wt %, Ru: 0.2-4.0 wt %, Hf: 0.01-0.2 wt %, and the balance being Ni and unavoidable impurities, and optionally the elements of C: 0.05 wt % or less, Zr: 0.1 wt % or less, V: 0.5 wt % or less, B: 0.02 wt % or less, Y: 0.2 wt % or less, La: 0.2 wt % or less, and Ce: 0.2 wt % or less alone or in combination.

2. A turbine blade or turbine vane component comprising the Ni-base superalloy as claimed in claim 1 as at least a part of its constitution.

3. A method for producing a Ni-base superalloy, comprising casting the Ni-base superalloy as claimed in claim 1 by a conventional casting method, a directional solidification method or a single crystal solidification method.

4. The method for producing a Ni-base superalloy as claimed in claim 3, wherein after casting, a pre-heat treatment at 1,260 to 1,300° C. for 20 minutes to 2 hours is applied, and a solution treatment at 1,300 to 1,350° C. for 3 to 10 hours, a primary aging treatment at 1,050 to 1,150° C. for 2 to 8 hours, and a secondary aging treatment at 800 to 900° C. for 10 to 24 hours are then applied.

* * * * *